United States Patent [19]

Bowen et al.

[11] Patent Number: 4,508,145

[45] Date of Patent: Apr. 2, 1985

[54] HEDDLE FRAME AND COMPOSITE FRAME SLAT CONSTRUCTION

[75] Inventors: James B. Bowen; Charles F. Kramer, both of Greenville, S.C.

[73] Assignee: Steel Heddle Mfg. Co., Greenville, S.C.

[21] Appl. No.: 395,736

[22] Filed: Jul. 6, 1982

[51] Int. Cl.[3] ..... D03C 9/06

[52] U.S. Cl. ..... 139/92

[58] Field of Search ..... 139/91, 92

[56] References Cited

U.S. PATENT DOCUMENTS

| | | | |
|---|---|---|---|
| 2,256,572 | 9/1941 | Pfarrwaller | 139/92 |
| 2,645,251 | 7/1953 | Haenny | 139/92 |
| 2,700,399 | 1/1955 | Pfarrwaller | 139/92 |
| 4,252,153 | 2/1981 | Kaufmann et al. | 139/92 |

FOREIGN PATENT DOCUMENTS

| | | | |
|---|---|---|---|
| 2427573 | 12/1975 | Fed. Rep. of Germany | 139/92 |
| 464112 | 11/1968 | Switzerland | 139/92 |

*Primary Examiner*—Henry S. Jaudon

*Attorney, Agent, or Firm*—Dority & Manning

[57] ABSTRACT

A heddle frame construction for a loom is disclosed which includes a bottom frame slat 14 constructed of a roll-formed steel tubular element which carries a latch block 30 which connects with a hook connector 28 of a heddle frame drive mechanism 26. A top frame slat 12 is constructed in part of a light extrusion and in part of a steel tubular element. Preferably, a first part includes a hollow steel tubular slat beam 36, 50, 70, 90, 100 having a shoulder on which a neck of a second part in the form of a connector flange 42, 56, 76, 92, 104 is carried. The connector flange has affixed thereto an upper supporting heddle rod 20 by means of rivet connections 21. The neck is uniquely constructed to include groove means 44, 62, 82 which interlock with free ends 38 and 40, 56*a* and 56*b,* 72 and 74 of the shoulder of the slat beam.

13 Claims, 16 Drawing Figures

Fig. 4a
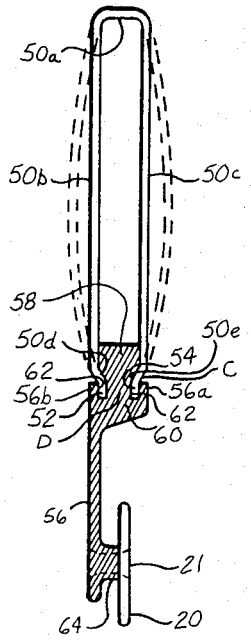
Fig. 4
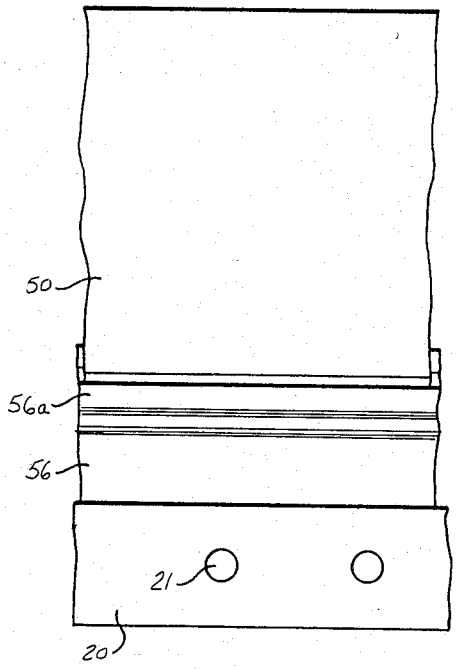
Fig. 3a
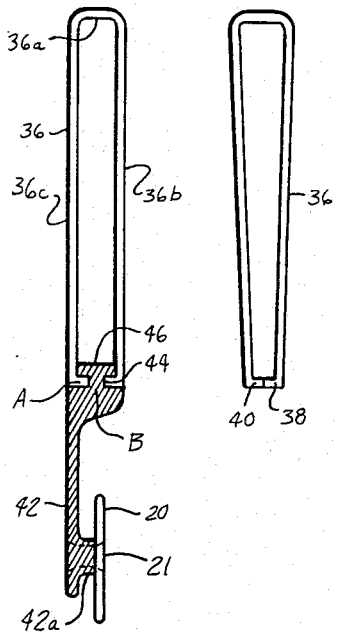
Fig. 3b
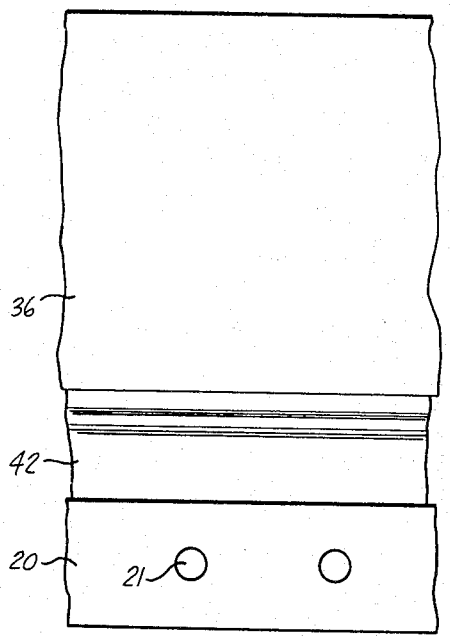
Fig. 3

HEDDLE FRAME AND COMPOSITE FRAME SLAT CONSTRUCTION

BACKGROUND OF THE INVENTION

The invention relates to a heddle frame construction for a loom of the type which includes a frame slat across the top and bottom of the heddle frame and heddle rods which may be attached to the frame slats between which heddles are carried in the frame. The bottom frame slat is connected to a heddle frame drive mechanism whereby the heddle frame is reciprocated up and down to create a shed in the warp yarns held in the central eyes of the heddles in which a weft yarn is inserted.

Due to the increasing speeds at which looms are operated and the increased dynamic forces encountered by the moving parts of the loom during high speed operation, the weight and structural integrity of these parts is a problem to which considerable attention must be given. In a heddle frame construction the heddle frame is driven by a heddle frame drive mechanism which typically includes hook connectors inserted within the hollow frame slat which hook upon a latch member fixed in the hollow frame slat. Not only must the bottom frame slat have sufficient structural strength to take the rigorous forces imparted by the drive mechanism, it must be sufficiently straight to prevent clashing against adjacent frames and binding of the heddles across the heddle rods.

Although the frame slat can be made stiffer by increasing the thickness of the outer walls and its height or weight, space limitations prevent this. The bottom frame slat must of necessity have a narrow dimension to accommodate the use of multiple heddle frames in close proximity to one another. Typically, the bottom frame slat must be no thicker than ten millimeters and the side walls of the hollow body slat no thicker than two millimeters to accommodate the space available on the loom. Thus, to meet the load requirements, frame slats typically have been constructed from high strength steel material. However, this adds considerable weight to the heddle frame structure.

Since the drive motion is normally not imparted to the top frame slat it is an object of the present invention to provide a top frame slat having a different construction than a hollow steel frame slat used for driving the heddle frame on the bottom so that the overall weight of the frame may be reduced without sacrificing structural integrity for high speed operation.

Swiss Pat. No. 464,112 discloses a frame slat for a loom constructed of a sheet metal or stainless steel tubular member which is formed to include hook ends for retaining heddles. However, it has been found that such shapes which are formed and heat treated often include dimensional and shape variances which are outside the acceptable tolerances for heddle frame constructions.

Typical heddle frame constructions including frame slats with integral slat beams and heddle rod supports are disclosed in U.S. Pat. Nos. 3,970,114, 3,754,577, 2,697,454, and Dutch Pat. No. 2,427,573.

Accordingly, an important object of the present invention is to provide a heddle frame having a tubular steel bottom frame slat by which the heddle frame is driven and a composite top frame slat which is of a lighter construction to provide a lighter overall heddle frame construction for high speed operation.

Still another important object of the present invention is to provide a frame slat for a heddle frame having a composite construction which combines the advantages of a steel construction in those areas of the frame slat where strength is required and which includes lightweight extruded constructions in other portions of the frame slat where the structural properties of steel are not required.

Still another important object of the present invention is to provide a frame slat for a heddle frame having a composite construction providing a lightweight frame slat for use on high speed looms.

SUMMARY OF THE INVENTION

It has been found that a heddle frame construction for a loom can be had which is reduced in weight but not in required structural integrity by providing a steel bottom frame slat and a composite top frame slat uniquely constructed from steel and aluminum portions. The bottom frame slat consists of an elongated hollow hardened steel tube which is roll formed for accuracy and by which the heddle frame may be driven. The top frame slat includes a first portion constructed from hardened steel tube and a second portion formed from a lightweight extruded material so that the total weight of the top frame slat is less than the weight of the bottom frame slat in the heddle frame. The first portion is preferably a hollow slat beam having a shoulder means formed at lower portion which is constructed of tubular steel and the second portion includes a connecting flange to which a heddle rod may be connected which is constructed from a lightweight extruded aluminum material. The connecting flange includes a neck which interfaces and connects with the shoulder portion of the hollow frame slat beam to provide an integral construction.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a partial elevation of a composite heddle frame according to the invention;

FIG. 3*a* is an end view of a hollow slat beam according to the invention;

FIG. 3*b* is an end view of FIG. 3 illustrating the hollow slat beam of FIG. 3*b* as engaged with an extruded flange portion;

FIG. 4 is a partial elevation illustrating a composite frame slat constructed according to the present invention;

FIG. 4*a* is an end view of FIG. 4;

DESCRIPTION OF A PREFERRED EMBODIMENT

Figure 1:
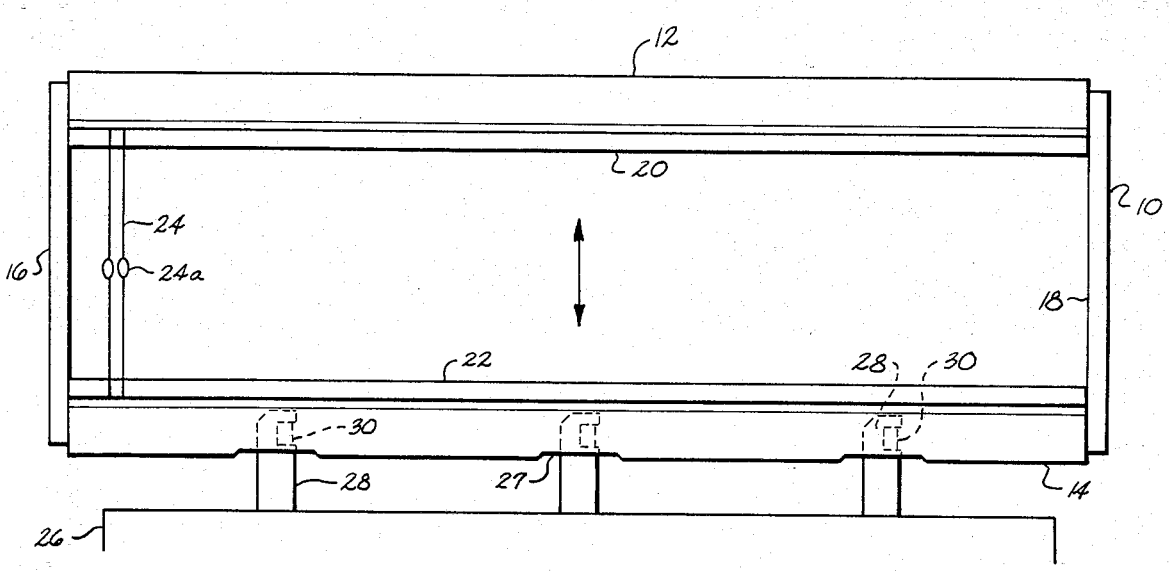
FIG. 1 is a front elevation of a heddle frame and drive mechanism for a loom according to the invention.

The invention relates to a heddle frame and frame slat construction for a loom. A heddle frame is illustrated at 10 which includes a top frame slat 12 and a bottom frame slat 14 carried between side frame members 16 and 18. A pair of heddle rods 20 and 22 are likewise carried between the frame sides 16 and 18 and are attached to the frame slats 12 and 14 for support. Heddles 24 carried between the top and bottom heddle rods have central eyes 24*a* in which an individual warp yarn end is threaded. During weaving, the heddle frame is reciprocated in rapid up and down strokes by means of a heddle frame drive mechanism indicated schematically at 26 such that the warp yarn ends held by the heddles are raised and lowered to define a shed between which the weft yarn is inserted.

Typically, the bottom frame slat 14 includes open slots 27 formed in the bottom thereof in which hook connectors 28 of heddle drive mechanism 26 are received to lock with latch block members 30 carried within the hollow interior of the bottom frame slat 14. Members 30 are typically blocks welded between the opposing side walls of the hollow frame slat 14 in the interior thereof.

As illustrated, according to the invention, bottom frame slat 14 consists of a P-shaped hollow steel tube having a bottom wall 14*a* and opposed side walls 14*b* and 14*c* terminating in a connecting flange portion 32 defined by double thick walls 14*d* and 14*e* rolled together. The P-shaped bottom frame slat is made from a continuously welded round steel tube which is progressively reshaped to the final P-shaped configuration in one operation. This rounded steel tube is preferably reshaped by a conventional roll forming process. It has been found that heat treating prior reshaped tubular members often results in variations which produce unacceptable tolerances in the heddle frame beam shape and assembly. The roll form process has been found to shape the frame slat according to the present invention more accurately within the tolerances required for heddle frame constructions. The heddle rod 22 may then be riveted to the connecting flange 32 by means of conventional rivets 34 with a spacer 35 therebetween.

posite top frame slat is illustrated as including a hollow frame slat beam 36 defined by a top wall 36*a* and side walls 36*b* and 36*c*. The side walls terminate in free ends 38 and 40 which turn inwardly to provide a connecting shoulder portion A. The shoulder portion A provides a means by which a neck portion B of a connector flange member 42 is interconnected with frame slat beam 36. The neck means B includes a pair of horizontal grooves 44 and an upper portion 46 fitted within the hollow interior of the frame slat beam 36. Connecting flange 42 is preferably extruded from aluminum or other light material and includes a rib 42*a* which serves to attach heddle rod 20 by means of rivets 21. Flange 42 extends along the entire length of slat beam 36.

The hollow frame slat beam 36 is formed as a steel tube member such that the ends 38 and 40 are biased toward each other and spread apart to be received in grooves 44. Thus, a mechanical clamp is created between the free ends 38 and 40 grooves 44 of neck B.

FIG. 4 illustrates yet another embodiment of a composite frame slat constructed according to the invention wherein a hollow frame slat beam is illustrated at 50 as including an upper portion 50*a* and integral side wall portions 50*b* and 50*c* preferably constructed from a bendable steel tubular element. The side walls 50*c* and 50*b* terminate in free ends 52 and 54 which define shoulder means C which interconnect with an extruded connecting flange 56.

Connecting flange 56 includes a neck portion D which includes a upper portion 58 fitted between the sides 50*c* and 50*b* of the beam and is integral with a reduced neck portion 60 having a pair of grooves 62 defined on either side thereof by upwardly turned sides 56*a* and 56*b*. Flange connector means 56 is preferably constructed as a lightweight aluminum alloy extrusion and includes a connecting rib 64 extending across the flange which makes connection with the top heddle rod 20 by means of rivet connection 21. Flange 56 extends across the full length of beam 50.

It will be noted that the sides 50*b* and 50*c* of beam 50 will deflect outwardly such as shown in dotted lines so that the free ends 52 and 54 may be received in the grooves 62 whereupon the sides may be allowed to assume their straight position as shown in solid lines. In this position the free ends will be interlocked in the grooves with the joining portions 50*d* and 50*e* abutting and conforming to a corresponding portion on the upper portion 58 of the neck means providing a mechanical clamp therebetween.

Figure 5A:
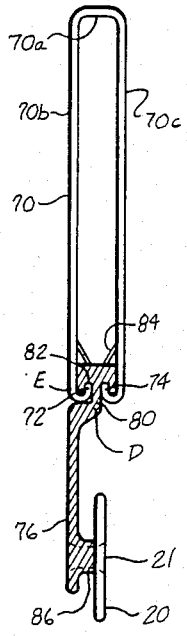
FIG. 5*a* is an end view of FIG. 5.
Figure 5:
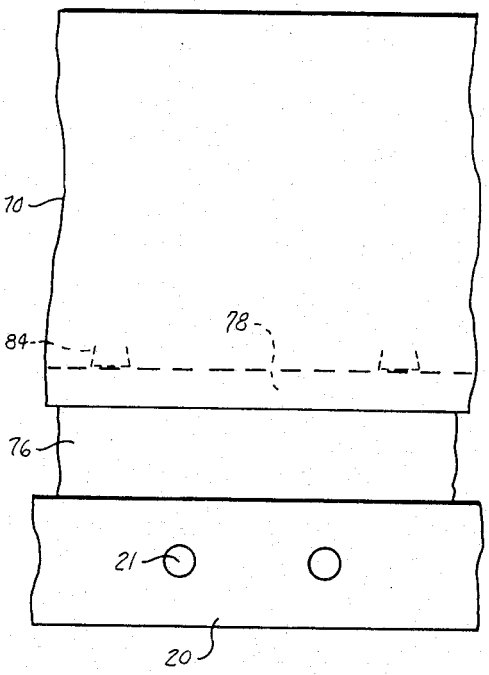
FIG. 5 is a plan view of another composite frame slat according to the invention.

FIGS. 5 and 5*a* illustrate yet another embodiment of the invention wherein a frame slat beam 70 is constructed of a high strength steel tubular element having an integral top end 70*a* and sides 70*b* and 70*c*. The side walls of the hollow beam terminate in upwardly turned free ends 72 and 74 in the form of generally U-shaped hook portions. The free ends thus define a shoulder means E which interfaces with a neck means D of a connecting flange 76.

Connecting flange 76 includes a upper portion 78 fitted between the sides of the frame slat beam which is integral with a reduced neck portion 80. The upper portion includes grooves 82 on either side of the reduced neck portion 80 in which the free ends 72 and 74 fit to provide connection. The upper surface of the lower body 78 is engaged by means of spaced ledge supports 84 carried in the interior of the hollow portion of beam 70 to clamp the upper portion 78 therein as hooked by free ends 72, 74. A connecting rib 86 is integral with the flange 76 to provide connection with the top heddle rod 20 by means of rivet 21. Flange 76 preferably extends the full length of beam 70.

Figure 6A:
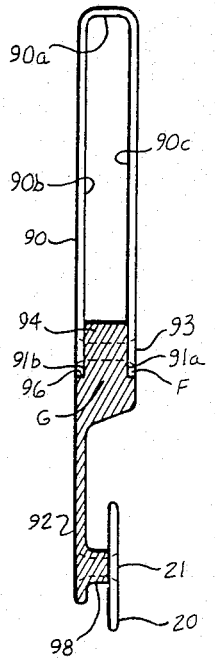
FIG. 6*a* is an end view of FIG. 6.
Figure 6:
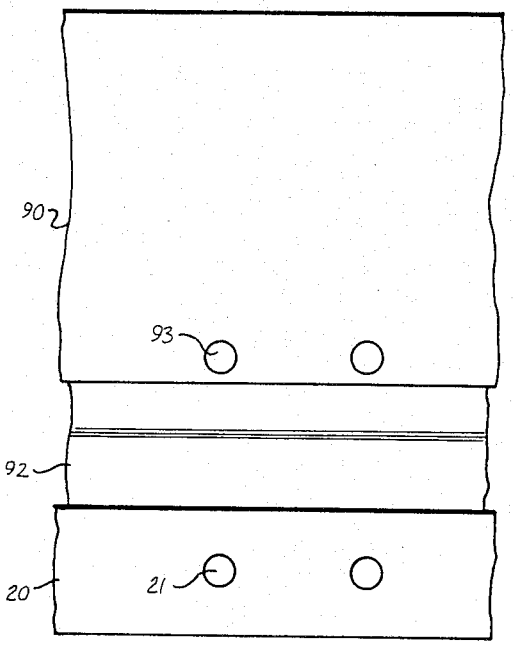
FIG. 6 is another embodiment of a composite frame slat according to the invention.

Referring now to FIGS. 6 and 6*a*, a composite heddle frame slat is illustrated which includes a hollow upper frame slat beam 90 and an upper connecting flange 92. The slat beam 90 includes an upper end 90*a* and integral side walls 90*b* and 90*c* terminating in free ends 91*a* and 91*b* which define an interconnecting shoulder means F. The connecting flage 92 includes a neck means G abutting shoulder F having a reduced upper portion 94 which fits between the sides 90*c* and 90*b* of the frame beam. The free ends of the sides 90*c* and 90*b* are thus supported against a widened base portion 96 of neck means G with a rivet connection 93 being made to secure the same together. The heddle rod 20 is riveted at 21 to a connecting rib 98 integral with flange 92.

While the extruded connecting flange 92 is illustrated as being a continuous piece across the width of the frame slat beam in FIGS. 6 and 6*a*, FIGS. 7 and 7*a* illustrate the same in the form of a holding element inserted into a hollow frame slat beam 100. Beam 100 includes an end portion 100*a* and side walls 100*b* and 100*c* which has an identical construction as that of FIG. 6 except that the frame beam has spaced bottom openings 102 in which a heddle rod holding element 104 is received and riveted thereto by means of rivets 106. Thus, the connecting flange is illustrated in the form of a holder element rather than a continuous flange across the length of the frame beam. Free ends of sidewalls 100*b* and 100*c* provide a shoulder means H on which neck means I of holding element 104 is carried. Neck means I includes a reduced portion 108 carried between the sides of the slat beam as illustrated. Element 104 includes flange 104*a* and rib 104*b* to which heddle rod 20 is riveted at 21.

Figure 2:
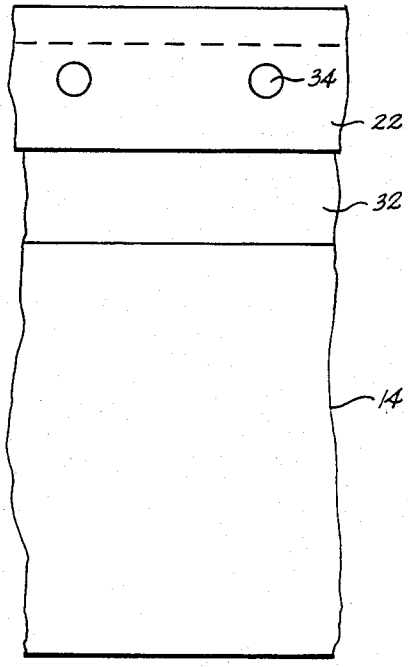
FIG. 2 is a partial elevation of a bottom frame slat for a heddle frame according to the invention.
Figure 2A:
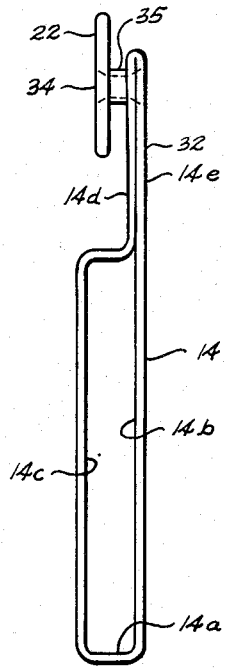
FIG. 2*a* is an end view of FIG. 2.
Figure 8A:
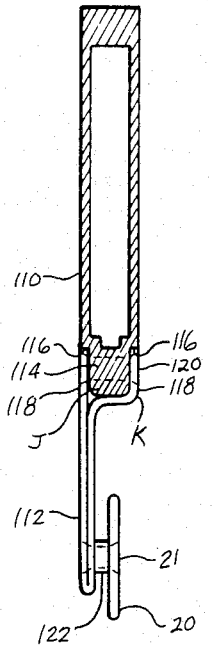
FIG. 8*a* is an end view of FIG. 8.
Figure 8:
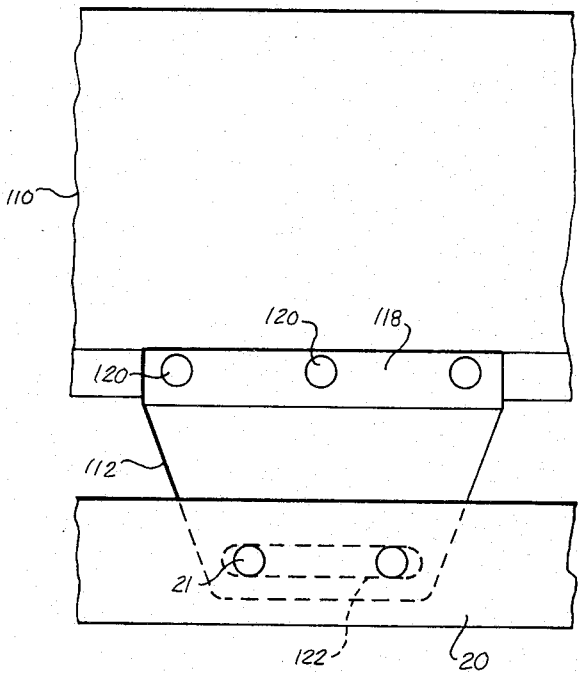
FIG. 8 is a partial elevation of yet another embodiment of a composite frame slat according to the invention.
Figure 7A:
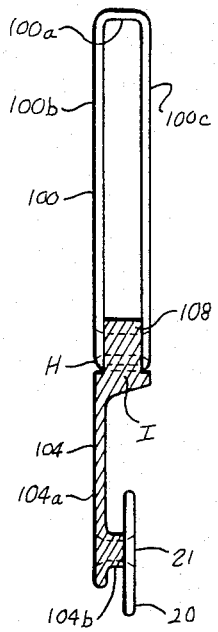
FIG. 7*a* is an end view of FIG. 7.
Figure 7:
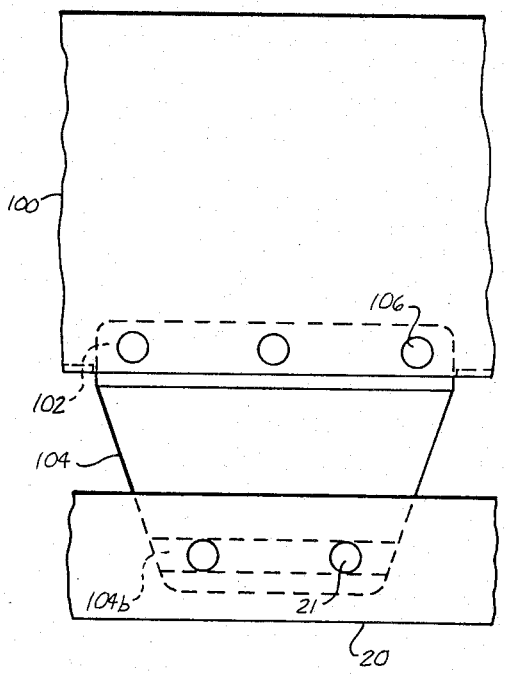
FIG. 7 is a partial elevation of another composite frame slat according to the invention.

FIG. 8 illustrates yet another embodiment of a composite heddle frame slat for the top of a heddle frame according to the invention wherein the frame slat beam is an extruded member 110 of a lightweight material such as an aluminum alloy and a connecting flange 112 is made of a high strength steel tube element. The frame slat beam 110 is a hollow member having a shoulder means J defined by a reduced end portion 114 having shoulders 116 on either side of the reduced portion. The connecting flange 112 terminates in free ends 118 which provide a neck K carried on the shoulder portion J and attached thereto by means of a rivet connections 120. The connecting flange 112 is preferably constructed in a roll forming process as is the bottom frame slat illustated in FIG. 2.

The top heddle rod 20 is connected to the connecting flange 112 by means of a spacer 122 and rivet connection 21. The connecting flange 112 is illustrated in the form of a heddle rod holder element disposed at spaced locations along the frame slat beam 110 and not a continuous member across the beam.

While a preferred embodiment of the invention has been described using specific terms, such description is for illustrative purposes only, and it is to be understood that changes and variations may be made without departing from the spirit or scope of the following claims.

What is claimed is:

1. A heddle frame for a loom in which is carried a number of heddles which are supported on heddle rods across the frame through which warp yarn ends are threaded and raised and lowered to define a shed across the loom through which a weft yarn is inserted as said heddle frame is reciprocated by a heddle frame drive during weaving, said heddle frame comprising:

a pair of spaced frame sides;

a top frame slat carried between said frame sides;

a bottom frame slat spaced below said top frame slat in said frame;

said bottom frame slat consisting of an elongated hollow steel tubular member having connector means carried therein for making drive connection with a heddle frame drive;

a flange means carried by said bottom frame slat;

an integral heddle support rod carried by said flange means for supporting the lower ends of said heddles;

said top frame slat including a first portion formed from a steel tubular element and a second portion formed from an extrusion of lighter material so that the total weight of said top frame slat is less than the weight of said bottom frame slat in said heddle frame; and said second portion of said top frame slat including an integral flange means, and an upper heddle support rod carried by said flange means for supporting the upper ends of said heddles in said frame.

2. The apparatus of claim 1 wherein said first portion of said top frame slat includes a hollow slat beam having shoulder means formed thereon, and said flange means includes a neck means interfacing and connecting with said shoulder means.

3. The apparatus of claim 2 wherein said neck means includes groove means formed therein, said hollow shaft beam including a top wall and a pair of integral side walls extending from said top wall terminating in a pair of opposed free ends turned inwardly towards one another, said side walls being flexible to an open position wherein said free ends are spread apart for being fitted in said groove means of said neck means and are biased inwardly for retention in said groove means.

4. The apparatus of claim 3 wherein said groove means includes an opposed horizontal elongated groove formed on opposing sides of said neck means and said free ends include horizontal projections which fit within the grooves.

5. The apparatus of claim 2 wherein said neck means includes a upper portion having a reduced neck terminating in groove means formed in said upper portion, said hollow slat beam having a pair of opposing resilient sides terminating in free ends which define said shoulder means, said free ends being receivable in said groove means to interlock the upper portion of said flange means between said flexible sides of said hollow slat beam when carried thereon.

6. The apparatus of claim 5 wherein free ends are vertical and said flexible side members flex outwardly to insert said free ends of said shoulder means within said groove means of said neck means which is vertically aligned with said free ends whereupon said flexible sides return to a straight configuration to interlock said free ends in said groove means.

7. The apparatus of claim 2 wherein said hollow shaft beam includes an upper wall and a pair of resilient side walls extending down from said upper wall, said opposing side walls terminating in hook portions having free ends which extend along and parallel to said side walls, said neck means including a portion having an open bottom groove formed therein, said hook portions fitting within said open grooves of said neck means.

8. The apparatus of claim 7 including ledge means carried in said hollow slat beam engaging said upper portion of said neck means.

9. The apparatus of claim 2 wherein said hollow shaft beam includes a top wall and a pair of integral side walls extending away from said wall, said neck means including an upper portion fitted between said side walls of said hollow slat beam terminating in horizontal shoulders engaged by free ends of said sides of said hollow slat beam which are affixed to sides of said upper portion received between said sides.

10. In a heddle frame for a loom in which is carried a number of heddles which are supported on heddle rods across the frame through which warp yarn ends are threaded and raised and lowered to define a shed across the loom through which a weft yarn is inserted during weaving, a frame slat carried across said heddle frame comprising:

a hollow frame slat beam constructed from a tubular steel element including a shoulder means;

flange means carried by said slat beam including neck means for interfacing and connecting with said shoulder means;

said flange means consisting of an extrusion constructed from a lighter material than said steel frame slat beam;

means connecting said heddle rod to said flange means; and said neck means including a portion having a reduced neck portion defining longitudinally extending groove means formed in siad neck means, said slat beam being hollow and having a pair of opposing resilient sides terminating in free ends which define shoulder means, said free ends being receivable in said groove means to interlock the portion of said flange means between said flexible sides of said hollow slat beam when carried thereon; said flexible sides spreading apart to facilitate interlocking of said free ends in said groove means.

11. The apparatus of claim 10 wherein said said free ends are vertical and said flexible side members flex and bow outwardly to insert said free ends of said shoulder means within said groove means of said neck means which is vertically aligned with said free ends whereupon said flexible sides return to a straight configuration to interlock said free ends in said groove means.

12. In a heddle frame for a loom in which is carried a number of heddles which are supported on heddle rods across the frame through which warp yarn ends are threaded and raised and lowered to define a shed across the loom through which a weft yarn is inserted during weaving, a frame slat carried across said heddle frame comprising:

hollow frame salt beam constructed from a tubular steel element including a shoulder means;

flange means carried by said slat beam including neck means for interfacing and connecting with said shoulder means;

said flange means consisting of an extrusion constructed from a lighter material than said steel frame slat beam;

means connecting said heddle rod to said flange means; and said neck means including groove means formed in said flange means, said hollow slat beam including an end wall and a pair of integral side walls extending from said end wall terminating in a pair of opposed free ends turned inwardly towards one another, said side walls being flexible to an open position wherein said free ends are spread apart for being fitted in said groove means of said neck means and are thereafter biased inwardly for retention in said groove means.

13. A heddle frame for a loom in which is carried a number of heddles which are supported on heddle rods across the frame through which warp yarn ends are threaded and raised and lowered to define a shed across the loom through which a weft yarn is inserted during weaving, a frame slat carried across said heddle frame comprising:

a hollow frame slat beam constructed from a tubular steel element including a shoulder means;

flange means carried by said slat beam including neck means for interfacing and connecting with said shoulder means;

said flange means consisting of an extrusion constructed from a lighter material than said steel frame slat beam;

means connecting said heddle rod to said flange means;

said hollow slat beam includes an end bottom wall and a pair of resilient side walls extending up from said end wall, said opposing side walls terminating in hook portions having free ends which in turn and extend along and parallel to said side walls, said neck means including a body portion received between said sidewalls having an open top groove formed therein said hook portions fitting within said open grooves of said neck means; and ledge means carried in an interior of said hollow slat beam engaging said body portion of said neck means.

* * * * *